United States Patent [19]

Ginzburg

[11] Patent Number: 4,735,116

[45] Date of Patent: Apr. 5, 1988

[54] SPREADING ROLLING MILL AND ASSOCIATED METHOD

[75] Inventor: Vladimir B. Ginzburg, Pittsburgh, Pa.

[73] Assignees: United Engineering Rolling Mills, Inc.; International Rolling Mill Consultants, Inc., both of Pittsburgh, Pa.

[21] Appl. No.: 860,101

[22] Filed: May 6, 1986

[51] Int. Cl.[4] ..... B21B 1/02; B21B 31/20; B21B 37/00

[52] U.S. Cl. ..... 72/22; 72/194; 72/240; 72/245; 72/247; 72/366; 72/243

[58] Field of Search ..... 72/243, 245, 242, 241, 72/240, 199, 20, 21, 247, 265, 366, 8–12, 20, 21–24, 365, 366

[56] References Cited

U.S. PATENT DOCUMENTS

| | | | |
|---|---|---|---|
| 3,096,672 | 3/1963 | Jones | 72/242 |
| 3,318,129 | 5/1967 | Gross | 72/199 |
| 4,238,946 | 12/1980 | Tsubota | 72/199 |
| 4,320,643 | 3/1982 | Yasuda et al. | 72/8 |
| 4,327,568 | 5/1982 | Berstein | 72/199 |
| 4,392,371 | 7/1983 | Okumura et al. | 72/231 |
| 4,440,012 | 4/1984 | Feldmann et al. | 72/201 |

FOREIGN PATENT DOCUMENTS

| | | | |
|---|---|---|---|
| 0131002 | 10/1981 | Japan | 72/247 |
| 0531562 | 10/1976 | U.S.S.R. | 72/245 |
| 0579048 | 11/1977 | U.S.S.R. | 72/245 |
| 0615957 | 7/1978 | U.S.S.R. | 72/245 |
| 617089 | 7/1978 | U.S.S.R. . | |
| 686794 | 9/1979 | U.S.S.R. . | |
| 0707623 | 1/1980 | U.S.S.R. | 72/199 |

*Primary Examiner*—Robert L. Spruill
*Assistant Examiner*—Steve Katz
*Attorney, Agent, or Firm*—Arnold B. Silverman

[57] ABSTRACT

A rolling mill has a pair of cooperating work rolls with first and second chock pairs associated with each work roll. At least one work roll is rocked in a direction generally perpendicular to the longitudinal axis of the work roll during operation of the rolling mill to enhance shear rolling and create regions of irregular thickness in the workpiece. This reduces friction between the work rolls and the workpiece in subsequent rolling thereby permitting greater lateral spread of the workpiece. The rocking may be effected in a generally vertical direction by a pair of cylinders secured to a pair of chocks or may be effected in a generally horizontal direction which may be that of the path of flow of the workpiece through the rolling mill by pairs of cylinders associated with each work roll or may involve rocking in both directions. A method of rolling a metal workpiece involves an initial reduction which establishes reduced portions and enlarged portions of the workpiece which are longitudinally spaced from each other and may be angularly disposed with respect to the rolling direction. Subsequently the workpiece is laterally expanded and a workpiece of desired width and generally uniform thickness is established.

28 Claims, 4 Drawing Sheets

SPREADING ROLLING MILL AND ASSOCIATED METHOD

BACKGROUND OF THE INVENTION

1. Field of The Invention

The present invention relates to a rolling mill and associated method which is adapted through specifically controlled stages of alteration of workpiece profile and, in certain preferred forms creating shear stresses and minimizing of friction between the work rolls and workpiece to provide an efficient means for rolling a metal workpiece.

2. Description Of The Prior Art

It has been known to provide a metal workpiece of given width through longitudinal slitting of the edges. This approach, however, can result in undesired production of substantial scrap.

It has also been known in connection with rolling of metal slabs to provide an initial profile from the sizing pass wherein the central portion of the slab is of reduced thickness with respect to the generally transversely outwardly diverging lateral portions thereof. Subsequently, the workpiece is rotated 90 degrees and it is run through a rolling millstand which providesa generally uniform thickness to the workpiece. The workpiece is subsequently rotated 90 degrees in the opposite direction from the initial rotation and further rolling is effect so as to provide a workpiece of desired uniform thickness. This practice is generally known as "broadsiding". One of the difficulties with this practice is the need to effect two 90 degree rotations of the workpiece. See generally U.S. Pat. Nos. 4,238,946 and 4,392,371.

It has also been known in rolling mills to effect axial displacement of rolls. See U.S. Pat. Nos. 4,320,643 and 4,440,012.

It has also been suggested to harden parts by cold rolling by applying a pulsating force to the workpiece. See U.S. Pat. No. 4,327,568.

It has also been suggested to increase the efficiency of rolling by applying pulsating force to the work rolls in vertical and horizontal planes. See generally USSR patents Nos. SU 617 089 and SU 686 794. These systems do not involve use of such concepts for spreading of the workpiece.

In spite of these known practices, there remains a need for a more efficient, more direct method and apparatus for effecting spreading of a metal workpiece during the rolling operation.

SUMMARY OF THE INVENTION

The present invention has met the above-described need by providing in one embodiment means for rocking at least one crown work roll. This may be accomplished by having oscillating means such as cylinders secured to the chocks of one work roll for rocking in a vertical plane. As a result of such rocking action and the associated shear forces applied to the workpiece, frictional resistance to lateral expansion of the workpiece is reduced thereby permitting increased spreading.

Another aspect of the present invention contemplates providing pairs of oscillating cylinders associated with both work rolls of each stand to thereby permit rocking of the work roll in a generally horizontal plane to further increase efficiency of spreading of the workpiece.

Operation of the rocking of work rolls both vertically and horizontally may be accomplished simultaneously with appropriate synchronization.

In a further embodiment of the invention, the cylinders for effecting relative vertical movement of the work rolls may connect the chocks of the two work rolls for relative movement therebetween.

In broader aspect of the method of this invention, crown rolls may be employed and the initial reduction may be effected with reduced portions and upwardly or downwardly projecting portions extending generally angularly with respect to the direction of rolling. Subsequent rolling without requiring significant rotation of the workpiece may be employed to spread the workpiece and effect substantially uniform thicknes of the same.

It is an object of the present invention to provide an efficient means of rolling a thick metal workpiece to the desired thickness and width without requiring the use of broadsiding.

It is a further object of the present invention to provide apparatus and an associated method for rocking work rolls either in a vertical plane, a horizontal plane or both in order to enhance shear rolling and achieve reduced frictional resistance to the lateral expansion of the workpiece.

It is a further object of the present invention to provide economical means for reduction of the effect of friction between the work rolls and workpiece so as to enhance spreading action while enabling the apparatus to be employed with otherwise conventional equipment.

These and other object of the present invention will be more fully understood from the following description of the invention on reference to the illustrations appended hereto.

DESCRIPTION OF THE PREFERRED EMBODIMENTS

Figure 1:
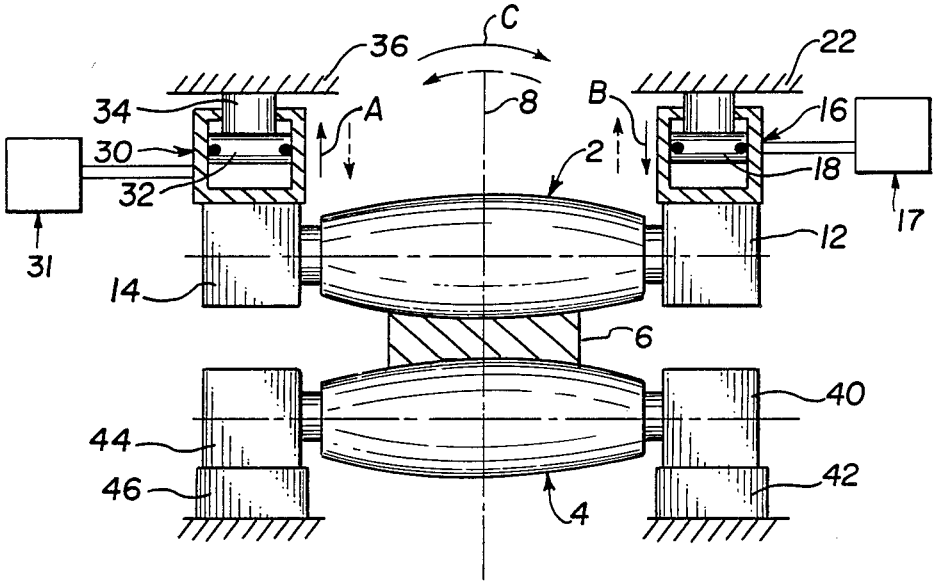
FIG. 1 is a schematic illustrational view of a two-high millstand of the present invention.

FIG. 1 illustrates an apparatus and method of the present invention which provides rocking of the upper crowned work roll 2. By coordinated reciprocation of the hydraulic cylinders as indicated by the arrows A, B, rocking of work roll 2 in a vertical plane as indicated by arrows C is effected. The millstand centerline has been indicated by the vertical dotted line 8.

Upper work roll 2 is rotatably journaled in chocks 12, 14. Cylinder 16, which may preferably be a hydraulic cylinder, is secured to chock 12 and has piston 18, piston rod 20 which is secured to housing portion 22. Similarly, cylinder 30 is fixedly secured to chock 14 and has piston 32 connected by piston rod 34 to housing portion 36. It will be appreciated that by coordinated operation of the cylinders 16, 30, work roll 2 may be rocked in a vertical plane by rotating roll 2 about an axis oriented perpendicular to the longitudinal axis of roll 2 alternately in a first rotational direction and then in a second, or opposite rotation direction thereby effecting alteration of the spacing between work rolls 2, 4. This rocking action produces variations in forces applied across the workpiece 6 to thereby produce zones of different thickness across the workpiece 6. (In FIG. 1, the cylinders 16, 30 are shown in equal vertical positions and the workpiece 6 variations in thickness across the width are due to the shape of the crown work rolls 2, 6.) As the rocking action is created in the vertical plane the amount of reduction of the workpiece in a given sector across the width will vary. This variation in roll bite will produce variations in shear stresses in the workpiece and provide variations in workpiece profile from longitudinal section to longitudinal section also due to the vertical rocking action. These irregularities produce reduced frictional resistance to subsequent rolling and lateral spreading of the workpiece.

By causing cylinders 16, 30 to oscillate with a relative phase shift of about 180 degrees and a frequency of about 3 to 10 cycles per second, more efficient spreading action is achieved. It is preferred that the amplitude of the oscillation be about 1 to 5 percent of the initial thickness of the workpiece 6. Such preferred frequency and amplitude in the vertical plane provide the desired shear forces and deformation within the workpiece 6 such that subsequent rolling to produce a workpiece spreading to the desired width and uniform thickness while reduced friction is experienced in such rolling.

While it will in general be most convenient to employ the cylinders with upper work roll 2 to move it with respect to lower work roll 4, if desired, the cylinders may be provided with lower work roll 4 by securing them to chocks 40, 42 and their respective supports 42, 46.

Figure 2:
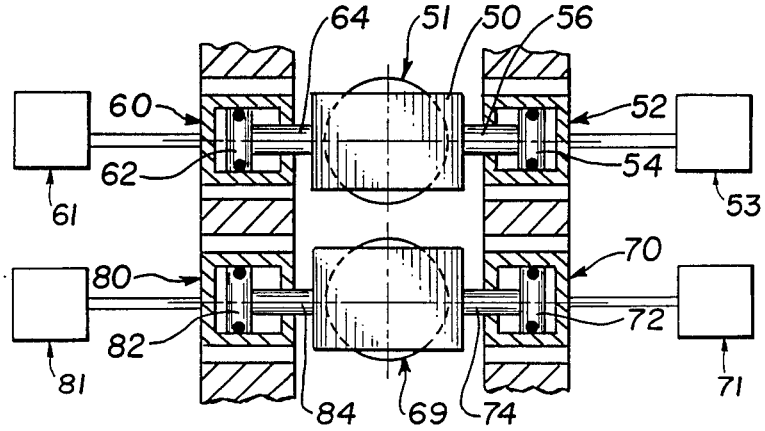
FIG. 2 is a schematic illustration, partly in section of another embodiment of the invention.

Referring now to FIG. 2 in greater detail, it is seen that the work rolls are adapted to be oscillated in a generally horizontal plane along a path which is generally the same as that of travel of the workpiece (not shown in this view). Chock 50 and its companion which is not shown in this view rotatably support work roll 51. Cylinders 52, 60 are fixedly connected to oppose sides of chock 50. Cylinder 52 has a piston 54 and piston rod 56 while cylinder 60 has a piston 62 and piston rod 64. It will be appreciated that by oscillation of these two cylinders with a preferred phase shift of about 180 degrees, the work roll may rock in a horizontal plane by rotating the roll about an axis oriented perpendicular to the longitudinal axis of roll 2 alternately in a first rotational direction and then in a second or opposite rotational direction. Similarly, work roll 69 is rotatably journaled in chock 68 and a second chock not shown in this view and cooperates with cylinder 70, 80. Cylinder 70 has piston 72 and piston rod 74 which is secured to chock 68 and cylinder 80 has piston 82 and piston rod 84 which is secured to chock 68. Not shown in this view are an additional four cylinders which would be secured to the chocks which correspond to 50 and 68 on the opposite side of the roll.

It will be appreciated that horizontal rocking action applied to the work rolls 51, 69 in synchronization elongated enlarged or reduced workpiece sections which are oriented angularly with respect to the line of rolling will be created. The rocking action produces reduction at a given roll bite profile at an angular position as distinguished from a position perpendicular to the line of rolling different shear forces are created in the workpiece. The resultant irregular thickness ("hills") in the workpiece reduces the amount of friction encountered in subsequent rolling and thereby facilitates improved efficiency of spreading to create the desired width and uniform thickness.

While in the preferred embodiment of the invention both coordinated vertical rocking and horizontal rocking are employed, either may be employed alone, if desired.

The cylinders employed in the present invention are preferably hydraulic cylinders and may be employed with conventional hydraulic fluid handling systems, valves and controls to accomplish the desired objectives.

Figure 3:
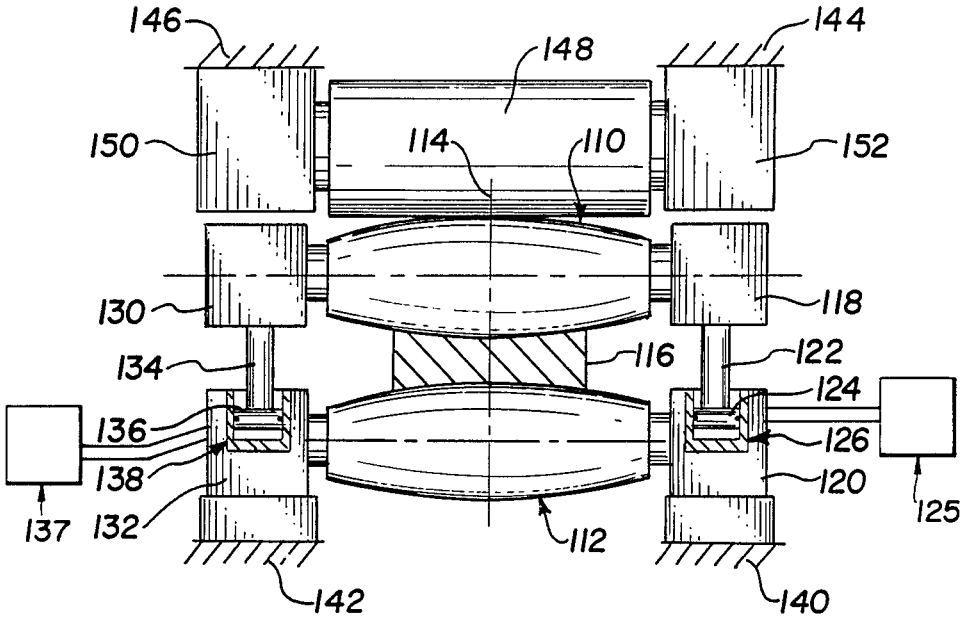
FIG. 3 is a schematic illustration of a further embodiment of the present invention.

Referring to FIG. 3 an alternate form of vertical adjustment means will be considered. In this embodiment, a pair of work rolls 110, 112 are crowned and are reducing a workpiece 116. The millstand has a centerline 114. At least one of the work rolls and, in the form shown, the top work roll 110 is supported by a backup roll 148 which is rotatably journalled in chocks 150, 152.

Chocks 118, 130 rotatably support work roll 110 and chocks 132, 120 rotatably support work roll 112. A first cylinder connects chocks 118, 122 and has piston rod 122 fixedly secured to chock 118 and piston 124 reciprocating within cylinder 126. Similarly, chock 130 is fixedly secured to piston rod 134 with piston 136 reciprocating within cylinder 138. It will be appreciated that by operation of cylinders 126, 138, the relative vertical spacing between work rolls 110, 122 may be altered so as to effect a reduction in frictional resistance to lateral spread of workpiece 116 thereby facilitating more efficient rolling. Chocks 150, 152 are fixedly secured over overhead housing portions 144, 146 and chocks 120, 132 are supported on housing portions 140, 142.

In the method of the present invention a rolling mill has at least two stands and in the first stand an initial reduction is effected through work roll rocking action wherein portions of the workpiece are reduced in thickness and other portions are enlarged. Subsequent reduction of the overall thickness results in spreading of the workpiece until the desired substantially uniform thickness of final product is achieved. The reduction in frictional resistance to spread may be effected through vertical rocking of at least one work roll or horizontal rocking of one of both work rolls or a combination of both.

FIGS. 4 through 10 illustrate the method of rolling which utilizes coordinated rocking of the work rolls 90 and 92 in both vertical and horizontal planes. The initial thickness is of workpiece 94 is being reduced down to thickness h and its initial width W is being spread to w.

Figure 4:
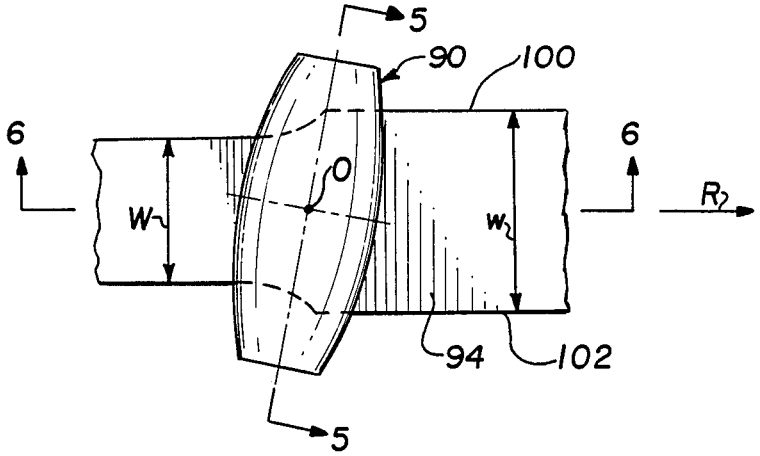
FIG. 4 is a schematic plan illustration of a millstand of the present invention with the work rolls at one end of the rocking cycle.
Figure 5:
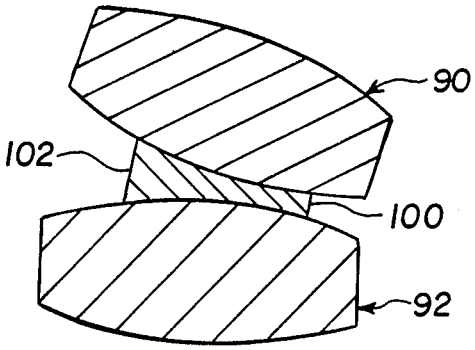
FIG. 5 is a cross-sectional illustration of the millstand of FIG. 4 taken through 5—5.
Figure 6:
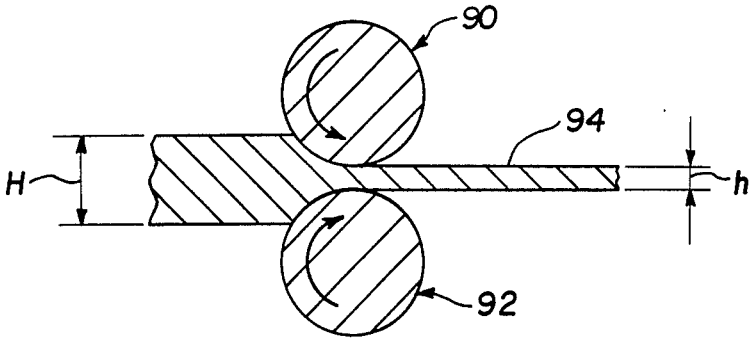
FIG. 6 is a cross-sectional illustration of the millstand of FIG. 4 taken through 6—6.

FIGS. 4–6 show the first extreme position of the work rolls 90 and 92. By rocking at least one of these rolls in vertical plane the roll gap at the workpiece edge 100 becomes substantially smaller than that at the workpiece edge 102. At the same time at least one of the work rolls 90, 92 is rocked in horizontal plane around vertical axes 0 in such a way that its end near the edge 100 is advanced toward the rolling direction R whereas its end near the edge 102 is moved in the opposite direction. The transverse variations in thickness across the workpiece are shown in FIG. 5.

Figure 7:
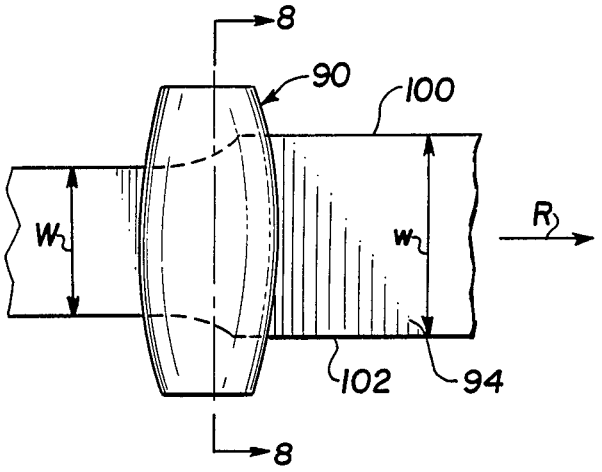
FIG. 7 is a schematic plan illustration of the millstand of FIG. 4 with the work rolls in an intermediate rocking position.
Figure 8:
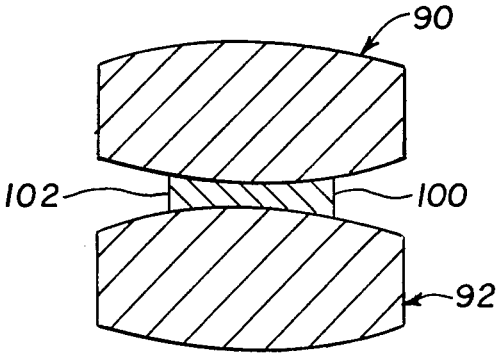
FIG. 8 is a cross-sectional illustration taken through 8—8 of FIG. 7.

FIGS. 7 and 8 show the intermediate position of the work rolls 90 and 92 when both rolls are parallel to each other and perpendicular to rolling direction R.

Figure 9:
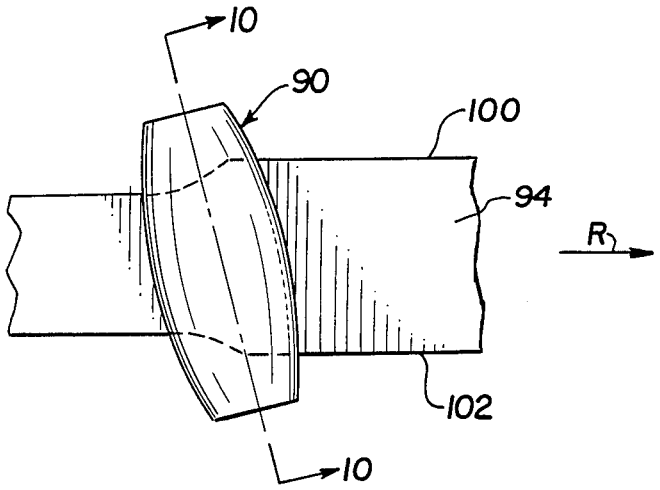
FIG. 9 is a schematic plan illustration of the millstand of FIG. 4 with the work rolls at the other end of the rocking cycle.
Figure 10:
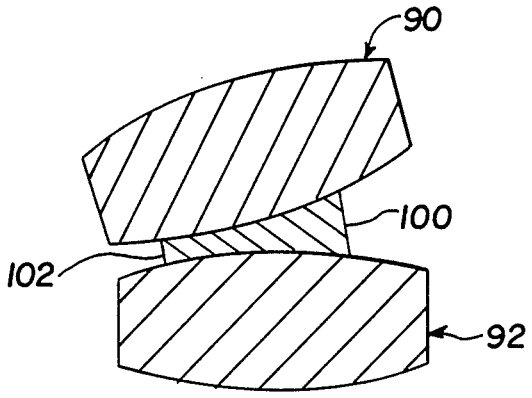
FIG. 10 is a cross-sectional illustration taken through 10—10 of FIG. 9.

FIGS. 9 and 10 show another extreme position of the work rolls 90 and 92 when by rocking at least one of these rolls in vertical plane the roll gap at the workpiece edge 102 becomes substantially smaller than that at the workpiece edge 100. At the same time at least one of the work rolls 90, 92 are rocked in horizontal plane around vertical axes 0 in such a way that its end near the edge 102 is advanced toward the rolling direction R whereas its end near the edge 100 is moved in the opposite direction.

The combined rocking of the crowned work rolls 90, 92 in both horizontal and vertical planes allows reduction of the workpiece thickness in such a way that desired draft equal to H−h may be achieved sequentially rather than simultaneously in a transverse section of the workpiece. This reduces rolling load.

At the same time the combined rocking of the crowned rolls will provide at each particular moment of time a wedge type cross-section of the workpiece in the roll bite in transverse direction. This enhances spreading of the workpiece.

Due to shearing effect resulting from rocking of the work rolls 90 and 92 in horizontal plane, the rolling load will be additionally reduced.

To resist undesired workpiece rocking, the workpiece may be retained either with sideguards or by applying tension in longitudinal direction of the workpiece. Another way of resisting rocking of the workpiece 94 is by rocking of the work rolls 90, 92 in horizontal plane in opposite relative directions.

EXAMPLE

By way of an example, the workpiece or slab of about 10 inches thick and about 40 inches wide is rolled through a multiple stand rolling mill. The initial reduction stand has a pair of rolls with length of about 80 inches. Upper roll has crown of about 1 inch and lower roll is substantially flat. The upper roll is adapted to be rocked in a generally vertical plane with amplitude near the workpiece edge of about 0.25 inches and frequency of about 3 cycles per second, whereas both upper and lower rolls are adapted to be rocked in a horizontal plane with 180 degrees phase shift and approximately the same amplitude and frequency of rocking. When the average peripheral roll speed is about 36 inches per second, the maximum differential speed between upper and lower rolls due to rocking will be about 9.4 inches per second, or about 26 percent of average peripheral roll speed. The longitudinal distance between hills on the workpiece will be about 12 inches. These periodic variations in thickness and width of the workpiece will be smoothed during subsequential rolling passes. Amplitude of the roll rocking is gradually reduced during the subsequent passes with decrease in thickness of the workpiece.

It will be appreciated, therefore, that the method and apparatus of the present invention provide an effective means of achieving the desired spread of a workpiece without necessitating either potentially wasteful edge slitting or requiring broadsiding. All of this is accomplished by reducing frictional resistance to the desired spreading and by enhancing the shear rolling through the use of rocking of the work rolls. This rocking may be achieved in a generally vertical plane, a generally horizontal plane or a coordinated system employing both vertical and horizontal rocking.

It will be appreciated that while many of the illustrations have shown two-high mills, the invention is not so limited and may be employed with other types of mills.

Whereas particular embodiments of the invention have been described above for purposes of illustration, it will be appreciated by those skilled in the art that numerous variations of the details may be made without departing from the invention as described in the appended claims.

I claim:

1. Rolling mill apparatus comprising
a pair of cooperating work rolls,
first chock means rotatably supporting a first said work roll,
second chock means rotatably supporting a second said work roll,
rocking means for rotating at least one said work roll about an axis oriented generally perpendicular to the longitudinal axis of said work roll during operation of said rolling mill, and
said rocking means having control means for effecting rotation alternately in a first rotational direction and then in a second rotational direction, whereby a workpiece will be provided with nonuniform thickness across the width and wherein said areas of greater thickness during subsequent rolling will be reduced to effect a predetermined width-wide spreading of the workpiece.

2. The rolling mill of claim 1 including
the longitudinal axes of said work rolls being generally horizontally oriented, and
said rocking means having first cylinder means secured to said first chock means for generally vertical oscillation of said first work roll.

3. The rolling mill of claim 2 including
said first chock means having first and second chocks, and
said first cylinder means having a first cylinder secured to said first chock and a second cylinder secured to said second chock.

4. The rolling mill of claim 3 including
said first cylinder and said second cylinder being hydraulic cylinders.

5. The rolling mill of claim 2 including
said first cylinder means rocking at about a 3 to 10 cycles per second rate.

6. The rolling mill of claim 1 including
said rocking means having first cylinder means connecting said first chock means with said second chock means, whereby relative displacement of said first work roll with respect to said second work roll may be effected.

7. The rolling mill of claim 6 including
said first chock means having a pair of chocks,
said second chock means having a pair of chocks,
said first cylinder means having a pair of cylinders each connecting a chock of said first chock means with a chock of said second chock means.

8. The rolling mill of claim 3 including said control means having means for effecting coordinated out of phase movement of said first cylinder and said second cylinder.

9. The rolling mill of claim 7 including said first cylinder means adapted to effect relative vertical rocking between said first and second work rolls.

10. The rolling mill of claim 7 including said first cylinder means having hydraulic cylinders.

11. The rolling mill of claim 1 including the longitudinal axes of said work rolls being generally horizontally oriented, and said rocking means having two first pairs of cylinders for rocking a first said work roll in a generally horizontal direction.

12. The rolling mill of claim 11 including said rocking means having two pairs of second cylinders for rocking a second said work roll in a generally horizontal direction.

13. The rolling mill of claim 5 including said first cylinder means rocking at an amplitude of oscillation of about 1 to 5 percent of the thickness of the workpiece.

14. The rolling mill of claim 12 including coordinating means for coordinating rocking of said first and second pairs of cylinders.

15. The rolling mill of claim 12 including said rocking means having a third pair of cylinders for generally vertical rocking of one said work roll.

16. The rolling mill of claim 15 including said first and second pairs of cylinders rocking said work rolls generally in a direction of travel of said workpiece.

17. The rolling mill of claim 16 including said cylinders being hydraulic cylinders.

18. The rolling mill of claim 2 or 11 including said work rolls being crown rolls.

19. A method of rolling a metal workpiece comprising providing at least two rolling millstands each having two cooperating work rolls, effecting an initial reduction of a metal workpiece by establishing reduced portions and enlarged portions therein while rocking at least one said work roll by rotating said work roll about an axis oriented generally perpendicular to the longitudinal axis of said work roll alternately in a first rotational direction and then in a second rotational direction, and subsequently without significant rotation of the workpiece with respect to the mill laterally expanding said workpiece and establishing a generally uniform thickness therein, whereby said initial reduction reduces the amount of friction experienced in said subsequent rolling.

20. The method of claim 19 including during said initial reduction forming said reduced portions in generally longitudinally spaced relative laterally offset positions with respect to each other.

21. The method of claim 20 including during said initial reduction establishing said enlarged portion of greater thickness than the thickness of the original workpiece.

22. The method of claim 21 including effecting generally vertical rocking of at least one said work roll of each said pair of work rolls.

23. The method of claim 22 including effecting said initial reduction by means of crowned work rolls.

24. The method of claim 22 including effecting generally horizontal rocking of at least one said work roll of each said pair of work rolls.

25. The method of claim 21 including effecting generally horizontal rocking of at least one said work roll of each said pair of work rolls.

26. The method of claim 22 including during said vertical rocking, altering the roll gap between the work rolls in order that it will periodically be greater adjacent one end of said rolls than adjacent the other said end, and establishing corresponding transverse variations in the thickness of said workpiece, whereby said rocking action will within a specific zone of said work rolls sequentially produce different workpiece thicknesses as said vertical rocking occurs.

27. The method of claim 26 including effecting said vertical rocking at a frequency of about 1 to 3 cycles per second.

28. The method of claim 27 including effecting said vertical rocking at an amplitude of oscillation of about 1 to 5 percent of the initial thickness of the workpiece.

* * * * *

UNITED STATES PATENT AND TRADEMARK OFFICE

CERTIFICATE OF CORRECTION

PATENT NO. : 4,735,116

DATED : April 5, 1988

INVENTOR(S) : VLADIMIR B. GINZBURG

It is certified that error appears in the above-identified patent and that said Letters Patent is hereby corrected as shown below:

In the first column on the Title Page under "U.S. PATENT DOCUMENTS", the date of the Jones patent should be --7/1963--.

Column 1, line 31, "effect" should be --effected--.

Column 2, line 8, "aspect" should be --aspects--.

Column 3, line 15, "rotation" should be --rotational--.

Column 4, line 59, "of" (second occurrence) should be --or--.

Column 4, line 64, "thickness is" should read --thickness H--.

Signed and Sealed this

Thirteenth Day of September, 1988

*Attest:*

DONALD J. QUIGG

*Attesting Officer*

*Commissioner of Patents and Trademarks*